US008391529B2

(12) United States Patent
Herman

(10) Patent No.: US 8,391,529 B2
(45) Date of Patent: Mar. 5, 2013

(54) WIND NOISE REJECTION APPARATUS

(75) Inventor: David Herman, Brighton (GB)

(73) Assignee: Audio-Gravity Holdings Limited (GB)

( * ) Notice: Subject to any disclaimer, the term of this patent is extended or adjusted under 35 U.S.C. 154(b) by 776 days.

(21) Appl. No.: 12/300,356

(22) PCT Filed: May 4, 2007

(86) PCT No.: PCT/GB2007/001659

§ 371 (c)(1),
(2), (4) Date: Mar. 9, 2009

(87) PCT Pub. No.: WO2007/132176

PCT Pub. Date: Nov. 22, 2007

(65) Prior Publication Data

US 2009/0310797 A1 Dec. 17, 2009

(30) Foreign Application Priority Data

May 12, 2006 (GB) ..... 0609416.3

(51) Int. Cl.
*H04R 9/08* (2006.01)

(52) U.S. Cl. ..... 381/359; 381/92; 381/94.1; 381/345

(58) Field of Classification Search ..... 381/92, 381/376, 345, 359, 94.1
See application file for complete search history.

(56) References Cited

U.S. PATENT DOCUMENTS

| | | | | |
|---|---|---|---|---|
| 3,652,810 | A | 3/1972 | Weingartner | 179/184 |
| 5,092,458 | A * | 3/1992 | Yokoyama | 206/316.2 |
| 5,715,321 | A * | 2/1998 | Andrea et al. | 381/92 |
| 7,366,308 | B1 | 4/2008 | Kock | 381/92 |
| 2002/0110256 | A1 | 8/2002 | Watson et al. | 381/389 |
| 2003/0142829 | A1 * | 7/2003 | Avigni | 381/26 |
| 2003/0147538 | A1 | 8/2003 | Elko | 381/92 |
| 2003/0194103 | A1 * | 10/2003 | Kakinuma | 381/361 |
| 2008/0118096 | A1 * | 5/2008 | De Pooter et al. | 381/359 |

FOREIGN PATENT DOCUMENTS

| | | |
|---|---|---|
| DE | 40 08 595 | 9/1991 |
| JP | 58-151796 | 6/1983 |
| JP | 58-144986 | 9/1983 |
| JP | 58-151796 | 9/1983 |
| JP | 2-137194 | 11/1990 |
| JP | 3-106299 | 5/1991 |
| WO | WO 2005/067653 A2 | 7/2005 |
| WO | WO 2006/103441 A1 | 10/2006 |

OTHER PUBLICATIONS

Translation of Office Action mailed Apr. 3, 2012 in corresponding Japanese application No. 2009-508470.
Translation of Office Action mailed Jul. 24, 2012 in corresponding Japanese application No. 2009-508470—pp. 10-12.
Japanese language Office Action mailed Jul. 24, 2012 in corresponding Japanese application No. 2009-508470.

* cited by examiner

*Primary Examiner* — Marcos D. Pizarro
*Assistant Examiner* — Tifney Skyles
(74) *Attorney, Agent, or Firm* — Renner Kenner Greive Bobak Taylor & Weber

(57) ABSTRACT

An apparatus for reduction of wind noise comprised of an electro-acoustic transducer arrangement with at least two and preferably three omni-directional transducer elements. The exposed structure is covered with a thin layer of acoustic-resistive material. The electrical outputs of the elements are added together to provide an output signal with increased signal to noise ratio.

4 Claims, 2 Drawing Sheets

WIND NOISE REJECTION APPARATUS

The present invention relates to use of electro-acoustic transducers and more particularly to an arrangement in conjunction with an electronic circuit which reduces the effects of wind noise in the case of a microphone.

The problem with wind noise in relation to microphones is well known and many solutions have been proposed. Such proposals have often required the use of complex signal processing equipment which increases the cost of a microphone quite considerably. Simpler solutions such as providing the microphone with a wind screen of some sort have also been proposed which can be effective, however, they are extremely bulky.

The present invention provides an electro-acoustic transducer arrangement comprising a plurality of omni-directional transducer elements covered by a thin acoustic resistive material. The outputs of the elements are added together to provide an output signal with increased signal to noise ratio.

In practice, it is preferred to use three or four elements

An advantage of the present invention is that there is no requirement for there to be a desired sound source present for the invention to work.

In order that the present invention be more readily understood, an embodiment thereof will now be described by way of example only with reference to the accompanying drawings, in which:—

Embodiments of the present invention comprise a plurality of omni-directional transducer elements. An omni-directional transducer element is one where there is a single port in a housing 10 with the diaphragm of the transducer disposed within the housing. The disposition of the elements with respect to one another is not significant as the advantages of the invention can be obtained irrespective of direction the elements face with respect to the sound source. In other words, the wind noise rejection effect is not significantly affected by the positioning of the ports of the elements with respect to the sound source nor by the direction that the wind is blowing.

However, there may be circumstances in which the elements are positioned relative to each other such that their ports are equidistant from a desired source. In one such arrangement, the elements can be located on the surface of an imaginary sphere so that they are all equidistant from the desired sound source. The microphones can be mounted in an enclosed container and exposed through a common hole. Furthermore, the microphones should be shielded from the wind with the housing 10 constructed of a thin acoustic resistive material that may surround them or at least placed over the exposed hole(s) H common to all microphone elements. This material can be thin felt or acoustic foam similar to that used to cover the ear pieces of headphones. The material should not significantly adversely affect the frequency response of the elements.

Figure 1:
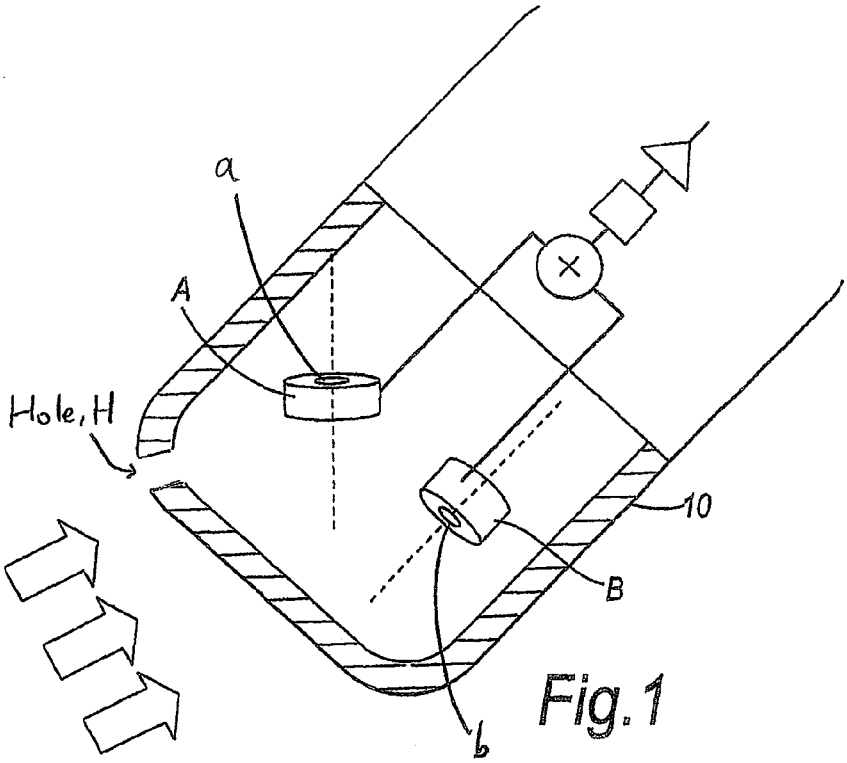
FIG. 1 shows diagrammatically a first embodiment of microphone in accordance with the present invention.

Referring now to FIG. 1, this shows an arrangement which comprises two omni-directional transducer elements A and B covered with a housing 10 constructed from a layer of acoustic resistive material which may be thin felt or acoustic foam similar to that used to cover the ear pieces of headphones. As such, the housing 10 does not affect the frequency response of the elements A and B. The outputs of the elements A and B are added together (not subtracted). It is to be noted that the ports a,b of the elements A and B face in very different directions but yet do not affect the performance of the arrangement.

Figure 2:
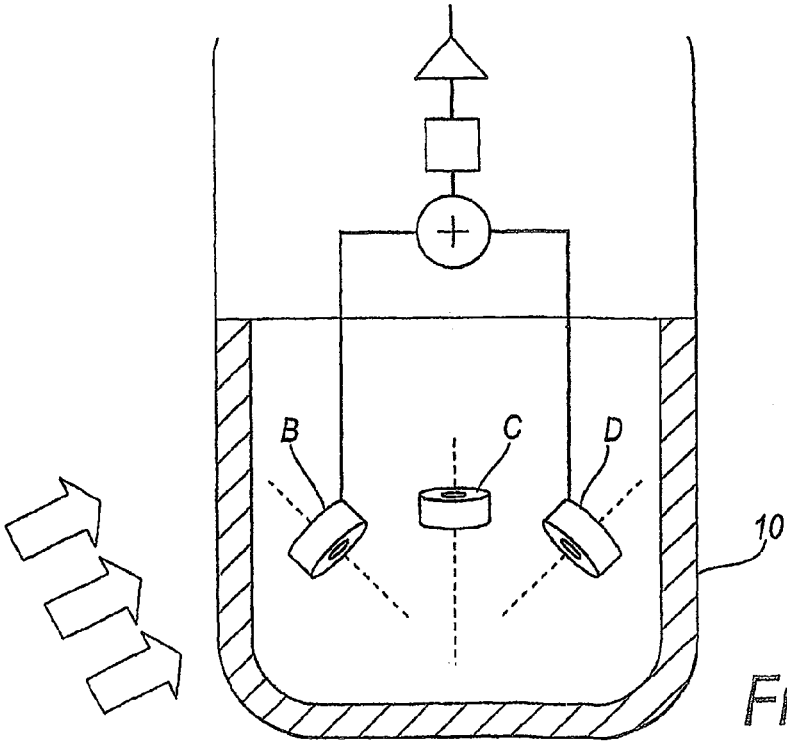
FIG. 2 shows diagrammatically a second embodiment of a microphone in accordance with the present invention.

If one considers FIG. 2, three omni-directional microphone elements are present and are disposed relative to each other so that they are physically in three dimensions and may be pointing at a common sound source. The elements are covered with housing 10 as in FIG. 1. The B and D elements in FIG. 1 are physically disposed in the same plane but the ports of the elements B and D point generally at a zone containing the sound source. In other words, the ports of the two elements are in the same plane but at different angles. The middle element C is physically above the plane as the elements B and D but it is tilted. Thus, it is pointing at the zone containing the sound source.

Figure 3:
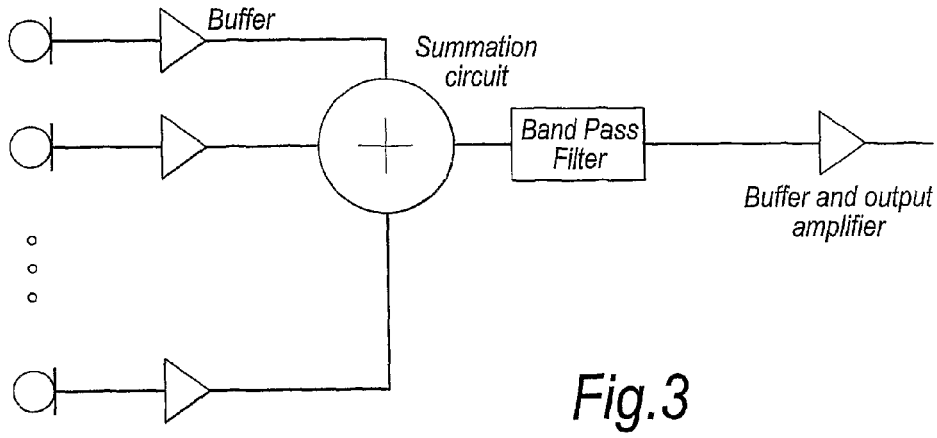
FIG. 3 shows a block diagram of a circuit for use with the microphone of FIG. 1 or 2.

Turning now to FIG. 3, it will be seen that with the arrangement of microphone elements shown in FIGS. 1 and 2, it is possible to arithmetically add the outputs of all the microphone elements and there may be two or more.

The electrical outputs can be added together in any convenient manner with equal signal weighting or gain using any suitable analogue or digital procedure such as digital signal processing.

Although the preferred embodiment utilises three omni-directional microphones, more than three microphone elements may be used.

It is to be noted that the omni-directional elements may be located within a housing 10 provided with or formed by a layer of acoustic resistant material. Alternatively, the elements may be located in a case or housing with one or more holes H, in which case only the holes need be covered with a layer of acoustic resistive material. Further, this material may be of a very thin variety such as that normally associated with headphones and therefore not burden the practical manufacturability of the invention.

One intended use is that the microphone elements will be mounted in some manner so that array is in a relatively fixed position with respect to the desired sound source. In the case of a microphone for use with a person, the microphone could be attached to the end of a boom which itself is part of an ear piece or headset. Alternatively, the microphone could be mounted in a helmet which may have an oxygen feed acting as an internal source of unwanted wind noise, or it could be used to replace the existing microphone in existing outside broadcast arrangements where the microphone is located within a cage which is arranged to be held against the face of a user with the microphone itself spaced from the user's mouth by a distance. Applications include wired or Bluetooth PHF (Personal Hands Free) for use with a mobile phone. The microphone may be used with a digital or video camera such that the desired sound is coming from approximately in front of the camera. The people speaking may be non-stationary or moving without affecting the desired affect wind noise rejection.

It is to be emphasised that the microphone elements described in relation to FIGS. 1 and 2 will enhance any sound whether or not the desired sound source is physically located in front of a port of one or more of the elements. Thus, precise location of the microphone with respect to, say, the mouth, is not required and it has been found that an array of microphone elements as described in relation to FIG. 1 or FIG. 2 will function satisfactorily even if the array is dangling near a suitable sound source and consequently receiving only off-axis signals.

Figure 4:
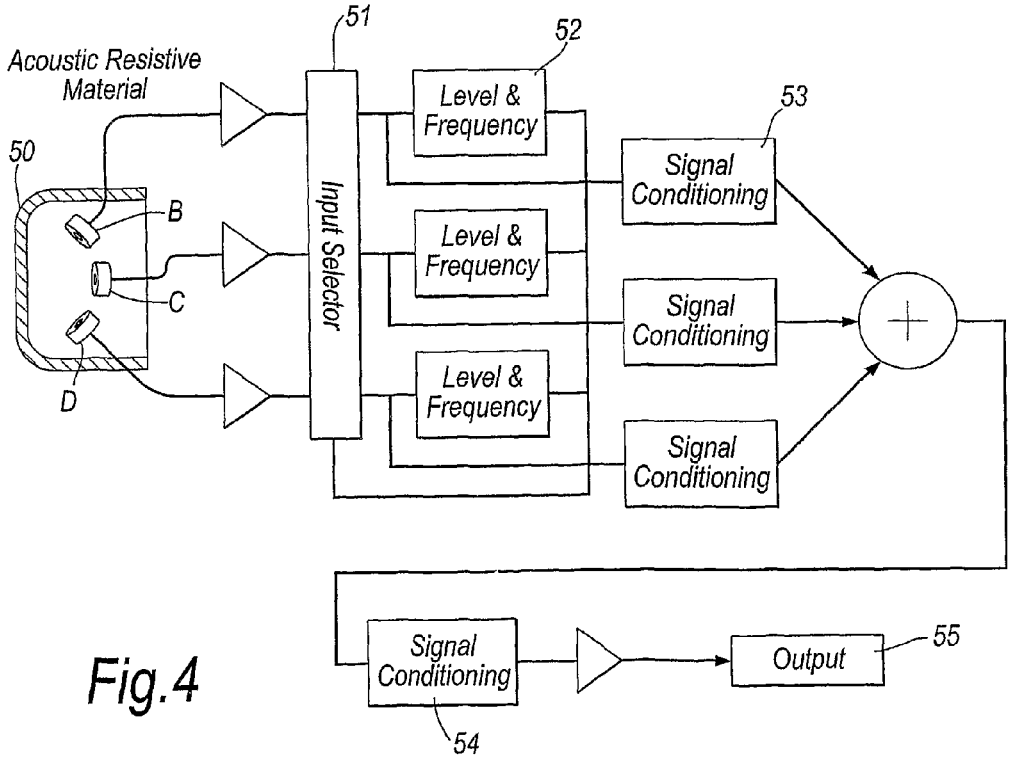
FIG. 4 shows a block diagram of a further arrangement including modified circuitry according to the present invention.

FIG. 4 shows a block diagram of a microphone array with electronic circuitry for carrying out signal processing if such is desired for any particular application e.g. should one or more of the elements be producing an inappropriate signal and it be desired to exclude it. There are many other methods for achieving this using either analog or digital solutions. In this figure, the microphone elements B,C and D are shown covered by a housing 50 formed from a common thin layer of acoustic resistive foam material. The outputs of the elements are fed to a selector circuit 51 where the signals are compared and the signal from the worst affected element is inhibited. Thereafter, the signals are fed through level and frequency control circuits 52, signal conditioning circuits 53 and then added together and fed to an output 55 after processing in a filter circuit 54 which applies band pass filtering below 200Hz. Other notch and band pass filtering can be provided to compensate for slight low frequency drop off in the voice frequency band.

The array of microphone elements replaces a conventional microphone and thus can be used as a direct replacement for such a microphone by being incorporated into equipment during manufacture. This may be achieved by incorporating the microphone elements and the associated signal addition circuitry as components of the larger equipment during manufacture. Alternatively, the microphone elements could be packaged in such convenient manner with or without their associated signal addition circuitry and provided to manufacturers as a module.

The array of omni-directional transducer elements, whether in modular form or not may be mounted in a housing which may be waterproof but is provided with an array of perforations covered by a thin layer of acoustic resistive material. The housing may be provided with means for attaching the array of elements to another piece of equipment on a user, e.g. by means of a spring clip. The present invention has wide application either as component parts of a larger piece of equipment or as a module for the larger equipment. To give some indication of the various applications, a number of different implementation will now be described. This is not an exhaustive list.

One implementation is to replace an outside broadcast microphone as indicated previously. Another is to replace the microphone in a mobile phone or part of a personal hands-free kit for a mobile phone. Another is to replace the microphone in portable recording devices.

A further implementation is to replace the microphone in a digital camera or video camera, video camera-phone, or another portable communication device. This can be either the microphone which is pointed at the user so that the user can comment on the scene being photographed. While the above arrangements are all disclosed with reference to wind and microphones, the same principles can be applied to other fluids such as water, in which case the transducer is normally termed a hydrophone.

Further, the omni-directional transducer elements can be fabricated using semi-conductor techniques which allows the array of elements to occupy very little space. A MEMs microphone sometimes referred to as a SiMIC (Silicon Microphone) will require the addition of a rear aperture or apertures to enable bi-directionality.

Using miniature omni-directional microphone elements in an appropriate array permits a version of the invention to be utilised in a hearing aid that is suitable for use outdoors and in breezy or windy conditions.

The invention claimed is:

1. A wind noise rejection apparatus comprising a plurality of omnidirectional transducer elements, means for receiving the outputs of the elements and for adding the outputs together, and an acoustically resistive material, wherein all the transducers are exposed to the wind, and the plurality of omnidirectional transducer elements are contained within a housing comprising one or more holes, wherein the transducer elements each comprise an input port and each input port is arranged to point in a direction away from the one or more holes, and said at least one input port is arranged to point in a direction away from the plane of the surface on which the hole is provided, and wherein the acoustically resistive material is at least placed over the one or more holes to cover the one or more holes entirely.

2. The apparatus according to claim 1, wherein there are at least three transducer elements located in an array forming part of an imaginary sphere or parabola.

3. The apparatus according to claim 1 wherein the elements are mounted at the appropriate angle and orientation by use of an over-moulded high temperature polymer which will be placed by the standard SMT process.

4. The apparatus according to claim 3 wherein the plurality of elements are manufactured using semiconductor micro fabrication techniques.

* * * * *